US009541080B2

(12) United States Patent
Hulse et al.

(10) Patent No.: US 9,541,080 B2
(45) **Date of Patent: *Jan. 10, 2017**

(54) MOUNTING ARRANGEMENT FOR AN OIL PUMP IN A REFRIGERATION COMPRESSOR

(71) Applicant: Whirlpool S.A., Sao Paulo (BR)

(72) Inventors: Emilio Rodrigues Hulse, Joinville (BR); Luiz Fabiano Jovita, Joinville (BR); Andrea Lopes, Joinville (BR)

(73) Assignee: Whirlpool S.A., San Paulo (BR)

( * ) Notice: Subject to any disclaimer, the term of this patent is extended or adjusted under 35 U.S.C. 154(b) by 85 days.

This patent is subject to a terminal disclaimer.

(21) Appl. No.: 14/333,594

(22) Filed: Jul. 17, 2014

(65) Prior Publication Data

US 2016/0017871 A1 Jan. 21, 2016

Related U.S. Application Data

(63) Continuation of application No. 12/998,280, filed as application No. PCT/BR2009/000335 on Oct. 7, 2009, now Pat. No. 8,827,662.

(30) Foreign Application Priority Data

Oct. 7, 2008 (BR) ..... 0804302

(51) Int. Cl.
*F04B 17/03* (2006.01)
*F04B 39/02* (2006.01)

(52) U.S. Cl.
CPC ..... *F04B 39/0238* (2013.01); *F04B 39/0246* (2013.01); *F04B 39/0261* (2013.01)

(58) Field of Classification Search
CPC .... F16L 39/04; F04B 39/0246; F04B 39/0253
USPC .... 417/360, 423.6; 184/6.5, 6.28; 285/121.3
See application file for complete search history.

(56) References Cited

U.S. PATENT DOCUMENTS

| | | | | |
|---|---|---|---|---|
| 3,128,905 A | 4/1964 | Hesslein | 220/760 |
| 3,778,089 A * | 12/1973 | Fredd | E21B 17/01 285/123.2 |
| 5,542,560 A | 8/1996 | Gerster et al. | 417/410.3 |
| 6,419,459 B1 * | 7/2002 | Sibbing | F04B 53/162 29/888.044 |
| 6,450,549 B1 * | 9/2002 | Schutz | F16L 13/143 285/256 |

(Continued)

FOREIGN PATENT DOCUMENTS

| | | |
|---|---|---|
| EP | 1 605 163 A1 | 12/2005 |
| JP | 2005-337158 | 12/2005 |

(Continued)

*Primary Examiner* — Charles Freay
(74) *Attorney, Agent, or Firm* — Harrington & Smith

(57) ABSTRACT

The refrigeration compressor includes a cylinder block carrying a crankshaft and a stator of an electric motor, whose rotor is mounted to the crankshaft. An oil pump including: a tubular sleeve affixed to the crankshaft or to the rotor with a pump body internal to the tubular sleeve and connected to the cylinder block. A fixation rod is articulated to the cylinder block or stator and has a lower portion angularly and freely displaced orthogonally to the rotational axis and around which the lower end portion of the pump body is axially retained and slidably mounted, orthogonally and coplanar to the rotation axis of the rotor.

8 Claims, 6 Drawing Sheets

(56) References Cited

U.S. PATENT DOCUMENTS

| | | | | |
|---|---|---|---|---|
| 6,450,785 | B1 * | 9/2002 | Dellby | F04B 39/0261 184/6.16 |
| 6,684,979 | B1 * | 2/2004 | Nakazato | F04B 39/0027 184/6.16 |
| 7,210,708 | B2 * | 5/2007 | Muto | B21D 39/048 285/242 |
| 8,827,662 | B2 * | 9/2014 | Hulse | F04B 39/0261 417/372 |
| 2004/0208758 | A1 * | 10/2004 | No | F04B 39/0246 417/372 |
| 2010/0074771 | A1 * | 3/2010 | Klein | F04B 39/0261 417/410.1 |
| 2010/0273351 | A1 * | 10/2010 | Holliday | H01R 9/0518 439/584 |

FOREIGN PATENT DOCUMENTS

| | | |
|---|---|---|
| WO | WO 93/22557 | 11/1993 |
| WO | WO 96/29516 | 9/1996 |
| WO | WO 00/01949 | 1/2000 |
| WO | WO 2005/047699 A1 | 5/2005 |
| WO | WO 2008/052297 A1 | 12/2005 |

* cited by examiner

MOUNTING ARRANGEMENT FOR AN OIL PUMP IN A REFRIGERATION COMPRESSOR

CROSS-REFERENCE TO RELATED APPLICATIONS

This application claims priority as a continuation of U.S. application Ser. No. 12/998,280, filed on Jun. 07, 2011, now U.S. Pat. No. 8,827,662, and which in turn claims priority as a National Stage Application of Patent Cooperation Treaty Application No. PCT/BR2009/000335, filed on Oct. 7, 2009, which claimed priority as a Brazilian Application No. PI0804302-7 filed Oct. 7, 2008. All of these applications are incorporated by reference herein in their entireties.

FIELD OF THE INVENTION

The present invention refers to a mounting arrangement for an oil pump and to an oil pump for a refrigeration compressor of the type which comprises, in the interior of a hermetic shell, a motor which carries a crankshaft having an upper end designed to drive the refrigerant gas pumping mechanism of the compressor, and a lower end carrying an oil pump immersed in a lubricant oil contained in an oil reservoir defined in the interior of the shell.

BACKGROUND OF THE INVENTION

An important factor for the correct operation of most refrigeration compressors is the adequate lubrication of the components thereof which have a relative movement therebetween. The lubrication is obtained by pumping the lubricant oil provided in an oil reservoir defined in the interior of a generally hermetic shell of said compressors, in a lower portion of said shell. The oil is pumped until reaching the parts with relative movement of the compressor, wherefrom said oil returns, for example, by gravity, to the oil reservoir.

In some known constructions, the compressor comprises a generally vertical crankshaft carrying a lubricant oil pump, which conducts said oil to the compressor parts to be lubricated, using the rotation of said crankshaft. In these constructions, the oil is pumped from the oil reservoir by centrifugation and mechanical dragging.

In these constructions, the crankshaft presents a portion of its extension provided, externally (WO2005/047699) or internally (WO96/29516), with helical grooves which conduct the lubricant oil from the oil reservoir to the relatively moving parts of the compressor provided away from the oil reservoir.

In WO2005/047699, a tubular sleeve is provided around part of the crankshaft which presents the helical grooves, said tubular sleeve being attached to the compressor shell or to the stator.

WO96/29516 presents a solution in which the crankshaft has part of its extension defining a conduct inside which is mounted, with a radial gap, a pump body, said solution presenting one of the parts of inner wall of the tubular shaft and outer wall of the pump body provided with helical grooves.

There are known some prior art solutions for oil pumping in variable speed compressors. In these constructions (WO93/22557, U.S. Pat. No. 6,450,785, JP2005-337158), the crankshaft inferiorly carries a pump body provided with surface channels and internally disposed in a tubular sleeve, one of the parts defined by the pump body and the tubular sleeve being rotatively stationary in relation to the other part, so as to provide the dragging effect on the oil being drawn by centrifugal force, resulting from the rotation of the motor.

Solution WO93/22557 presents the pump body externally provided with helical grooves and affixed to the crankshaft so as to rotate therewith, the tubular sleeve being attached to the electric motor stator by a fixation rod, said tubular sleeve being mounted around the pump body with a radial gap.

Such solution allows friction wear to occur between the parts of pump body and tubular sleeve, as well as mechanical losses, as a result of the rigid fixation between said tubular sleeve and the stator and of practically inevitable misalignments between the pump body and the tubular sleeve.

Documents U.S. Pat. No. 6,450,785 and JP2005-337158 each presents a solution in which the pump body provided with helical grooves in its outer surface is inferiorly affixed to the electric motor stator through a fixation rod with a U-shaped profile, and the tubular sleeve is affixed to the crankshaft of the compressor so as to rotate therewith. Each of these solutions present a construction in which the fixation rod is rigidly affixed to the electric motor stator (or to a motor protector inferiorly affixed in said stator), allowing only a certain angular movement of the pump body around axes contained in the lower fixation plane of the pump body to the fixation rod, said plane being orthogonal to the crankshaft of the compressor. Thus, the fixation rod can be elastically deformed to allow the pump body to incline so as to accommodate itself in the interior of the tubular sleeve. However, as the pump body is not free to be displaced, in its entirety, in directions orthogonal to the crankshaft, as a function of the rigid fixation of the fixation rod to the motor, it is not capable of compensating for construction or mounting misalignments, in order to occupy a position in which its axis is concentric or parallel to the axis of the tubular sleeve.

Although reducing wear and friction losses, these known prior art solutions still lead to a certain efficiency loss, particularly considering the inevitable dimensional deviations during manufacture and assembly.

The Brazilian co-pending patent document PI0604908-7 (WO2008/052297) presents the pump body freely displaceable in the interior of the tubular sleeve, in radial directions orthogonal to the crankshaft and rotatively locked in relation to the rotor, the supporting means of said pump body being a rigid rod having the first portion loosely fitted in a radial housing provided in the lower end portion of the pump body, so as to support the latter. Thus, the dimensional deviations of both the pump body and the tubular sleeve are absorbed by said pump body freely moving through the gap between the lower radial housing of the pump body and the rigid rod.

While said prior art solution PI0604908-7 minimizes the effects of the dimensional deviations regarding wear and friction losses, it introduces the collateral effect of providing intermittent contacts between the components defined by the pump body and supporting rod. The contact between the surfaces, upon high rotation speeds of the mechanism, generates an undesirable noise in the operation of the compressor.

Besides the issues regarding the free displacement of the pump body inside the tubular sleeve, in radial directions orthogonal to the crankshaft, with a rotative locking in relation to the pump rotor, the prior art solutions for the oil pump of a refrigeration compressor present a deficient fixation of the pump part (pump body or tubular sleeve) to the crankshaft or rotor, when said pump part is made of a non-metallic material. In the known solutions having a tubular sleeve or a pump body (EP0728946) in a material different from that of the crankshaft or rotor, particularly a non-metallic material, such as plastic, there occurs with time a degradation in the quality of the fixation obtained, since the operational conditions of the compressor, such as heating, affect the degree of interference between the parts affixed to each other. In case the tubular sleeve or the pump body is made of plastic, this material will present deformation when submitted to heating upon operation of the compressor, causing loss of said interference and consequent loosening of the fixation initially obtained.

Objects of the Invention

It is an object of the present invention to provide a mounting arrangement for an oil pump in a refrigeration compressor, which allows the pump body of said oil pump to be concentrically mounted inside the tubular sleeve of said oil pump, with freedom to move in radial directions orthogonal to the crankshaft, with a rotative locking in relation to the pump rotor and without allowing generation of undesirable noises, upon operation of the compressor at high rotation speeds, by intermittent contacts between the pump body and the supporting or fixation rod.

Another object of the present invention is to provide an arrangement which comprises an oil pump such as cited above, presenting a non-metallic tubular sleeve which can be securely attached to any of the metallic parts of the compressor defined by the rotor and crankshaft.

It is a further object of the present invention to provide an arrangement such as cited above, which guarantees an adequate lubrication of the compressor parts with relative movement, even in low rotation speeds.

Another object of the present solution is to provide an arrangement such as cited above, whose construction minimizes the problems regarding wear and the increase in the energy consumption of the parts of said oil pump, due to loss of concentricity and friction between said parts, and which presents a low noise at high rotation speeds.

It is a further object of the present invention to provide an arrangement such as cited above, which allows a construction with high precision and easy to be mounted.

It is also another object of the present invention to provide an arrangement such as cited above, which presents a reduced cost and an easy construction.

Summary of the Invention

These and other objects of the present invention are achieved by the provision of a mounting arrangement for an oil pump in a refrigeration compressor, which comprises a shell containing lubricant oil and carrying a cylinder block journalling a crankshaft; an electric motor having a stator affixed to the cylinder block and a rotor mounted around the crankshaft; and an oil pump coupled to the crankshaft and having: a tubular sleeve having an upper end portion affixed to one of the parts of crankshaft and rotor; and a pump body disposed in the interior of the tubular sleeve and having a lower portion carried by the assembly defined by the cylinder block and stator, so as to be freely displaced in the interior of the tubular sleeve in radial directions orthogonal to the rotation axis of the rotor and rotatively locked in relation to the rotor, said arrangement comprising a fixation rod having an upper portion articulated to one of the parts of cylinder block and stator, according to an articulation axis which is orthogonal and coplanar to the rotation axis of the rotor, and a lower portion angularly and freely displaced according to a direction orthogonal to said articulation axis and around which the lower portion of the pump body is axially retained and slidably mounted, according to a direction orthogonal and coplanar to the rotation axis of the rotor.

In a particular aspect of the arrangement of the present invention, the fixation rod is U-shaped, having a pair of side legs whose upper ends define the upper portion of the fixation rod and whose lower ends are connected by a base leg which defines the lower portion of the fixation rod.

In another particular aspect of the present invention, the upper end portion of the tubular sleeve is provided with a circumferential groove, inside which a tubular metallic connector is fitted and rotatively and axially retained to be then telescopically mounted and retained in one of the parts of rotor and crankshaft.

BRIEF DESCRIPTION OF THE DRAWINGS

The invention will be described with reference to the enclosed drawings, given by way of example of embodiments of the invention and in which:

FIG. 7 represents a simplified enlarged partial longitudinal sectional view of a refrigeration compressor, illustrating a way of attaching a tubular sleeve, in a non-metallic material, to the rotor of the type illustrated in FIG. 1*a.

DESCRIPTION OF THE ILLUSTRATED EMBODIMENTS

Figure 1:
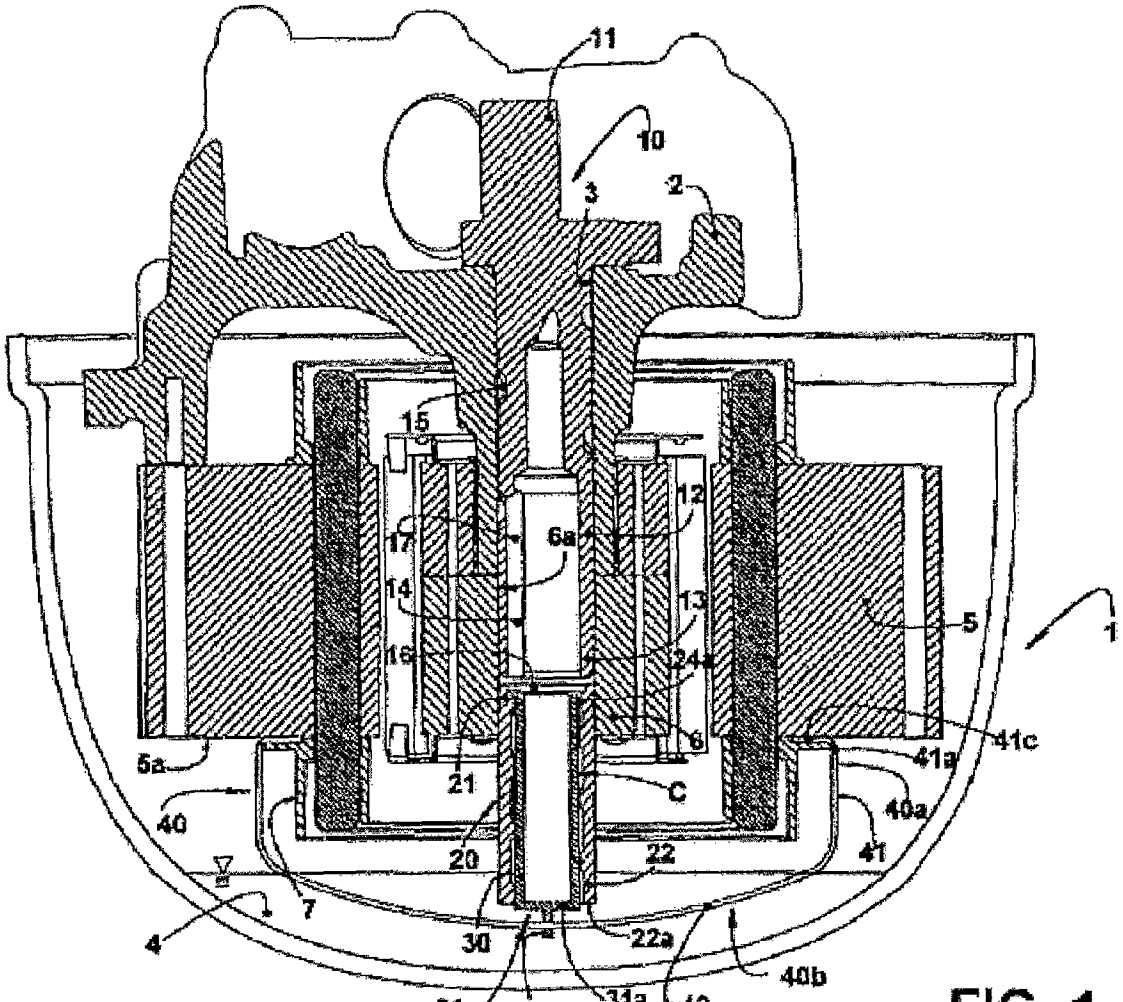
FIG. 1 schematically represents a longitudinal sectional view of a refrigeration compressor with a vertical shaft, said compressor presenting a rotor provided with a central axial hole having a lower extension which is not occupied by the crankshaft and in which interior there is directly attached a metallic tubular sleeve of an oil pump constructed according to a first embodiment of the invention, partially immersed in the oil of an oil reservoir defined in a lower portion of the shell of said compressor.

The present invention will be described for a reciprocating hermetic compressor (for example of the type applied to a refrigeration system, such as a small sized or household refrigeration system) presenting a generally hermetic shell 1, housing a cylinder block 2 which defines a cylinder 3 within which actuates a reciprocating piston (not illustrated), in a lower portion of the shell 1 being defined an oil reservoir 4, wherefrom the oil that lubricates the movable parts of the compressor is pumped through an oil pump.

In the construction described herein, the refrigeration compressor is of the type driven by a crankshaft 10 which moves the piston, said crankshaft 10 being journalled in the cylinder block 2 and presenting, superiorly, an eccentric portion 11 and, inferiorly, a tubular end portion 12 in which, from a lower end 13, a vertical inner channel 14 is defined, for example with a cross-section in the form of a circular segment, which maintains fluid communication with a helical external oil channel 15 provided in the crankshaft 10 and which takes the oil pumped by an oil pump to the compressor parts to be lubricated.

The cylinder block 2 secures a stator 5 of an electric motor including a rotor 6 having a central axial hole 6*a* through which said rotor 6 is fitted and attached to the crankshaft 10, so as to rotate the latter upon operation of the motor.

The oil pump is also operatively affixed to one of the parts of crankshaft 10 and rotor 6, so as to rotate therewith, and presents a lower portion immersed in the lubricant oil contained in the oil reservoir 4, and an upper portion defining a natural extension of the lower portion of the crankshaft 10.

The oil pump comprises a tubular sleeve 20 which is mounted around a pump body 30, said tubular sleeve 20 having an upper tubular portion 21 affixed to one of the parts of crankshaft 10 and rotor 6, so as to be rotated by rotation of said rotor 6, directly upon movement thereof or by rotation of the crankshaft 10, and a lower portion 22 having a lower end 22*a* immersed in the lubricant oil.

The elongated tubular pump body 30 is disposed in the interior of the tubular sleeve 20, so that an outer surface of the pump body 30 maintains a certain radial gap in relation to an adjacent confronting inner surface of the tubular sleeve 20, said pump body 30 having a lower end portion 31 projecting beyond the lower end 22*a* of the tubular sleeve 20, so as to be affixed to the assembly defined by the cylinder block 2 and stator 5, more particularly to the latter.

According to a preferred way of carrying out the present invention, the pump body 30 has its lower end portion 31 comprising a closed lower wall 31*a* medianly and inferiorly incorporating a flange 31*b* (FIGS. 2, 2*a*, 3 and 3*a*). In this construction, the pump body may or may not present an upper wall, which can be for example opened. In another way of carrying out the present invention, said pump body 30 presents a closed upper wall 32, from which extends a generally diametrical inner central wall 33 having a lower end portion 33*a* projecting beyond the tubular body, in order to define the lower portion 31 of the latter.

For any of the solutions discussed herein, the pump body may be solid or internally hollow.

In the oil pump constructions illustrated in the drawings, the tubular sleeve 20 presents an inner face 23 which is provided, along at least part of its longitudinal extension, with at least one helical groove 24 upwardly extending from the lower end 22*a* and defining, with an adjacent confronting outer surface portion of the pump body 30, lubricant oil ascending channels C which conduct oil from the oil reservoir 4, which oil is pumped by the present oil pump, to the compressor parts with relative movement. The pump body 30 is mounted in the interior of the tubular sleeve 20, so as to move freely therewithin in radial directions orthogonal to the crankshaft 10, but said pump body 30 being rotatively fixed in relation to the rotor 6.

Since the helical groove 24 is provided in the inner face of the tubular sleeve 20 and not in the outer surface of the pump body 30, the oil pump presents an effect of centrifugal force and mechanical dragging superior to that of the prior art oil pump constructions.

In order not to alter the oil flow being upwardly dragged, the oil ascending channels C, defined by the helical grooves 24 produced in the inner face 23 of the tubular sleeve 20, can be dimensioned so that the thickness thereof varies proportionally to the thickness variation of at least one of the parts of tubular sleeve 20 and pump body 30.

The tubular sleeve 20 is coupled to at least one of the parts of crankshaft 10 and rotor 6, so as to be rotatively driven with the part that carries it upon rotation of the rotor 6, said movement being provoked by operation of the electric motor, whilst the pump body 30 remains rotatively fixed. The relative movement between the tubular sleeve 20 and the pump body 30 provokes an upward movement of oil from the oil reservoir 4, by mechanical dragging and centrifugal force.

A first aspect of the present invention relates to the mounting of the pump body 30 in the interior of the tubular sleeve 20, independently of how the latter is constructed, whether in metallic or non-metallic material and whether affixed to the rotor 6 or to the crankshaft 10.

According to said first aspect of the invention, the mounting arrangement of the pump body 30 comprises a fixation rod 40, having an upper portion 40*a* articulated to the assembly defined by the cylinder block 2 and stator 5, according to an articulation axis which is orthogonal and coplanar to the rotation axis of the rotor 6, and a lower portion 40*b* angularly and freely displaced according to a direction orthogonal to said articulation axis and around which the lower end portion 31 of the pump body 30 is axially retained and slidably mounted, according to a direction orthogonal and coplanar to the rotation axis of the rotor 6,.

In the illustrated constructive form, the fixation rod 40 presents a U shape with a pair of side legs 41, whose upper ends 41*a* define the upper portion 40*a* of the fixation rod 40 and whose lower ends 41*b* are connected through a base leg 42 which defines the lower portion 40*b* of the fixation rod 40.

Each side leg 41 of the fixation rod 40 has its respective upper end 41*a* incorporating an articulation shaft portion 41*c*, the two articulation shaft portions 41*c* of the illustrated fixation rod 40 being mounted in respective bearings carried by one of the parts of cylinder block 2 and stator 5, according to the articulation axis. In the illustrated construction, each articulation shaft portion 41*c* is defined by bending the fixation rod 40 at the region of the upper end portion 40*a* of the latter, in an angle close to 90° in relation to the side leg 41 from which extends a respective articulation shaft portion 41*c*, said bending being defined, for example, so that the articulation shaft portions 41*c* are spaced away from each other, but facing each other.

However, it should be understood that the fixation rod 40 defined herein may present other constructive forms, such as a C shape having only one upper end for articulation of the fixation rod to one of the parts of cylinder block 2 and stator 5. Besides, each upper end 41*a* of the side leg 41 may present a construction different from that illustrated, but which allows the fixation rod 40 to be articulated to the articulation axis, in an orthogonal and coplanar manner in relation to the rotation axis of the rotor 6. Said articulation shaft portions 41*c* can be turned outwardly or further present a ball-joint shape, being incorporated, in a single piece, to the remainder of the fixation rod 40 or also affixed to the latter by appropriate means, such as welding, gluing, fitting, screwing, threading, etc.

In a way of carrying out the present invention illustrated in the enclosed drawings, the stator 5 presents a lower end face 5*a* carrying a motor protector 7, in the form of a lower insulating cover, provided around the windings of the stator 5 turned to the oil reservoir 4, said motor protector 7 being provided with a pair of bearings, each defined by a cradle 7*a* formed in a flange portion 7*b* of the motor protector 7 and which rotatively supports a respective articulation shaft portion 41*c*.

In the illustrated construction, the two cradles 7*a* are aligned to each other and formed in a face of the motor protector 7 that is turned and adjacent to the lower end face 5*a* of the stator 5, so that said adjacent lower end face 5*a* defines an upper portion for each cradle 7*a*.

Figure 5:
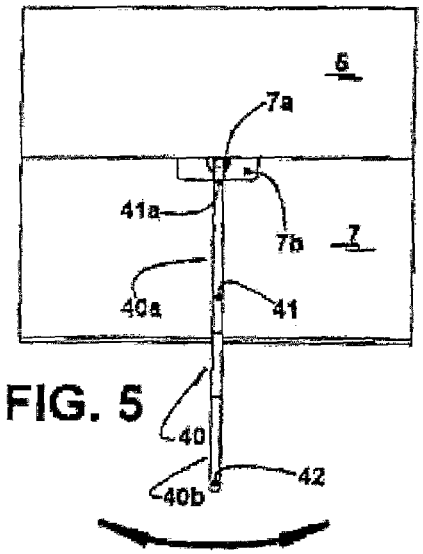
FIG. 5 represents an end view of the articulation region of the fixation rod, when taken according to the direction of arrow V in FIG. 4, indicating, by continuous arrows, the angular movement of the fixation rod around an articulation shaft.

As indicated in FIG. 5, each articulation shaft portion 41*c* is mounted in a respective cradle 7*a*, so as to present a rotation movement around its mounting axis, as already defined. This rotation movement causes an oscillating movement of the fixation rod, as indicated in said FIG. 5 by a pair of lower arrows in opposite directions.

According to the present invention, the lower portion 31 of the pump body 30, defined by the flange 31*b* or lower end portion 33*a*, is provided with a through-hole 34 having its axis orthogonal and coplanar to the rotation axis of the rotor 6 and through which the lower portion 40*b* of the fixation rod 40 is slidably mounted. In the illustrated constructions, the fixation rod 40 has its base leg 42 mounted through the through-hole 34 with a reduced radial gap, so as to maintain the pump body 30 fixed in radial directions orthogonal to the fixation rod 40 and to allow the pump body 30 to have a determined freedom to slide along the base leg 42 of the fixation rod 40, in a direction orthogonal to that of articulation around the articulation axis.

According to the illustrations in the enclosed figures, the lower end portion 31 presents the through hole 34 provided with a gap which is only sufficient for allowing the mounting of the fixation rod 40.

According to the present invention, while a particular construction of fixation rod 40 has been described, it should be understood that said fixation rod may present any profile which guarantees the desired movement, so as to absorb errors of concentricity and assembly of the components. However, the fixation of said fixation rod to the part that carries it should be effected by fixation means which allow the fixation rod to rotate around an axis perpendicular to a plane containing the articulation portions and the crankshaft 10, said fixation means being, for example, handles, pins, etc. It should be understood that the mounting arrangement of the fixation rod 40 described herein is not limited to the provision of specific oil pump constructions, neither to particular aspects of rotor formation.

Figure 6:
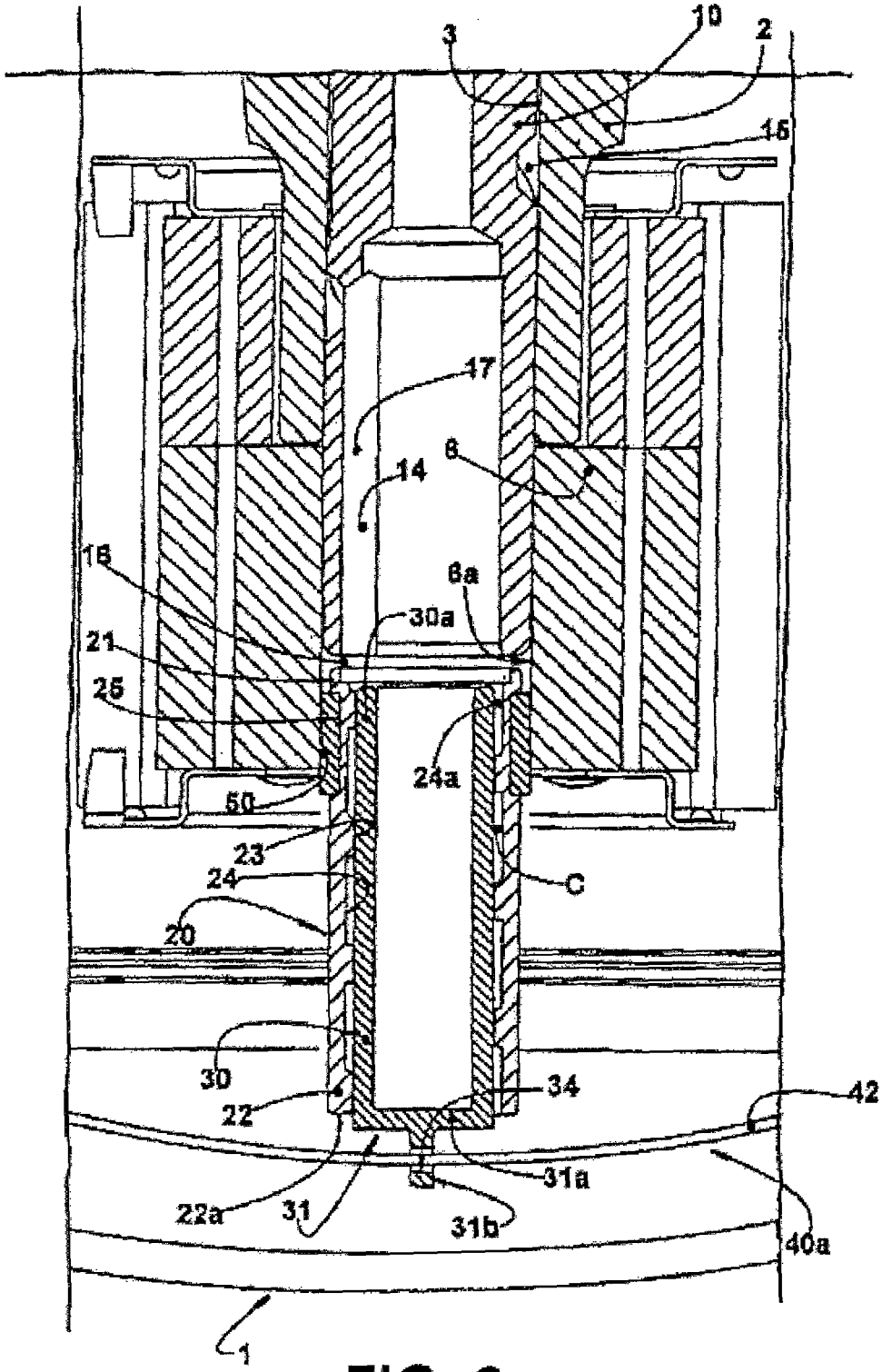
FIG. 6 represents a simplified enlarged partial longitudinal sectional view of a refrigeration compressor, illustrating a way of attaching a tubular sleeve, in a non-metallic material, to the rotor of the type illustrated in FIG. 1.

In the constructions illustrated in FIGS. 1 and 6, the rotor 6 is provided with a central axial hole 6*a* having a lower extension not occupied by the crankshaft 10 and inside which is directly fitted and affixed, by mechanical interference, the metallic tubular sleeve 20 of an oil pump.

Figure 1A:
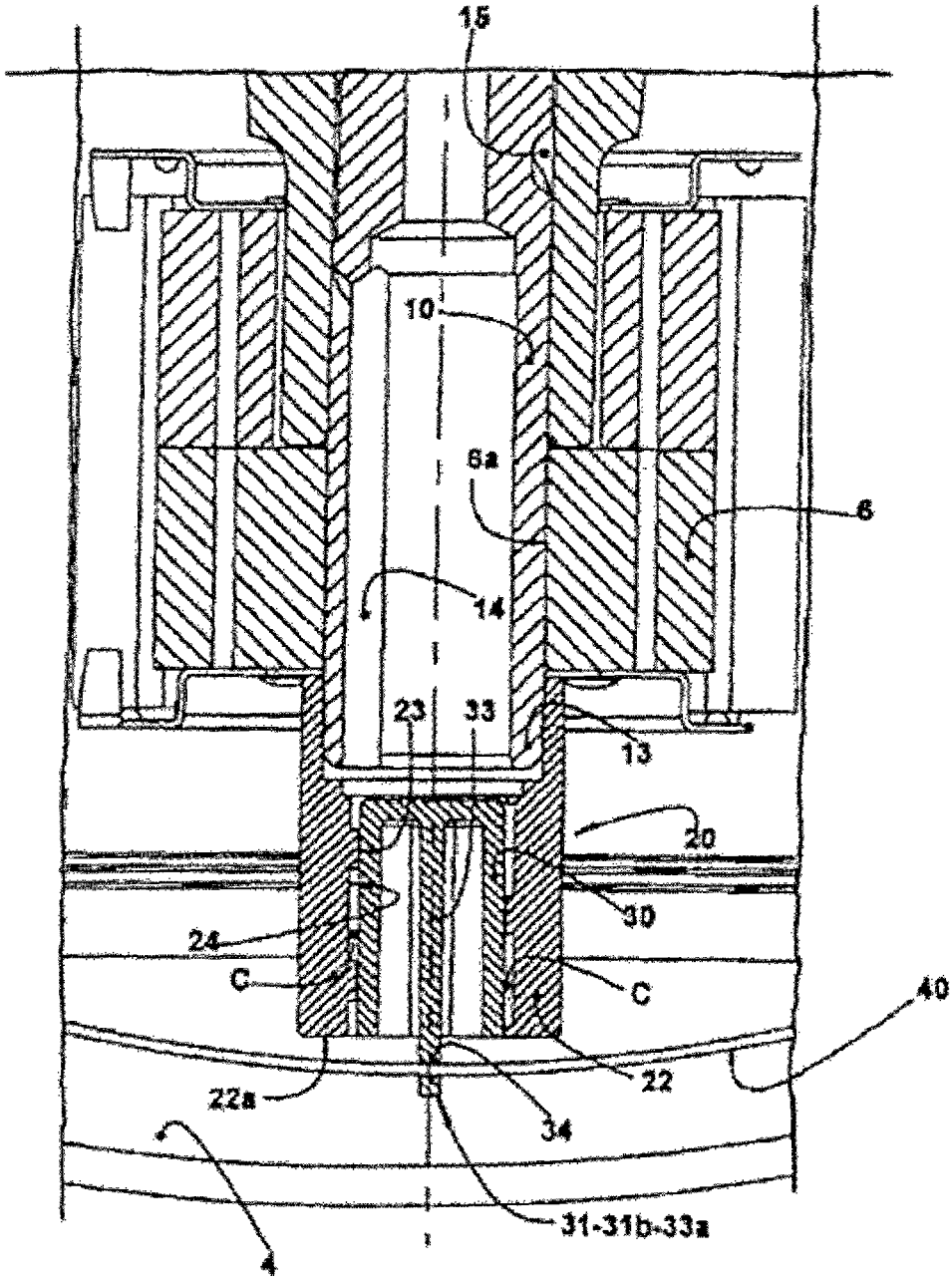
FIG. 1*a* schematically and partially represents a view such as that of FIG. 1, for a construction in which a lower extension of the crankshaft projects downwardly from a low-height rotor, in order to attach the tubular sleeve, according to a second embodiment for the oil pump of the present invention.
Figure 2:
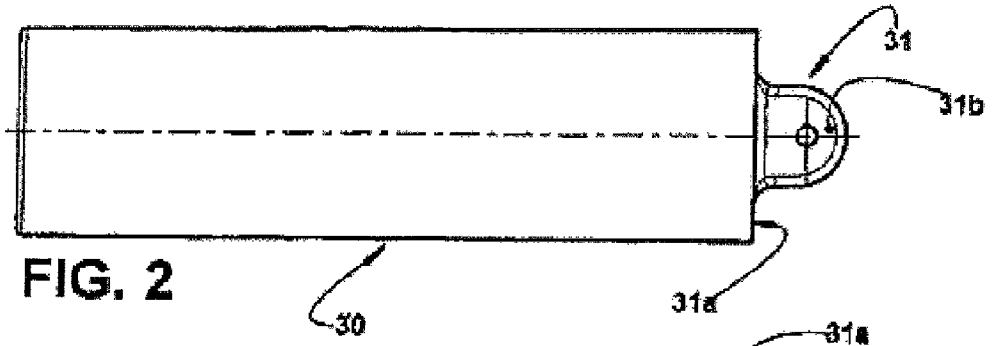
FIGS. 2 and 2*a* represent, in a simplified form, a side view and a longitudinal sectional view of a first constructive form for the pump body illustrated in FIG. 1.
Figure 2A:
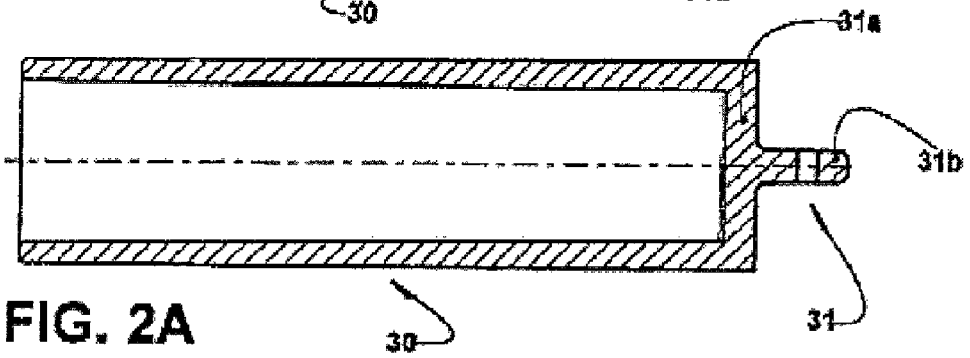
Figure 3:
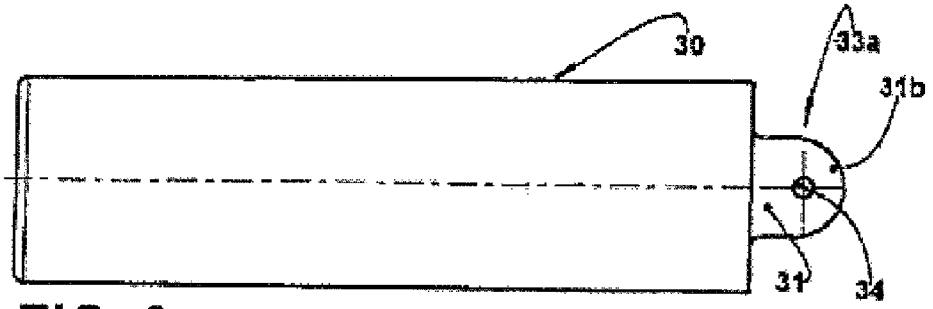
FIGS. 3 and 3*a* represent, in a simplified form, a side view and a longitudinal sectional view of a second constructive form for the pump body, illustrated in FIG. 1*a;*
Figure 3A:
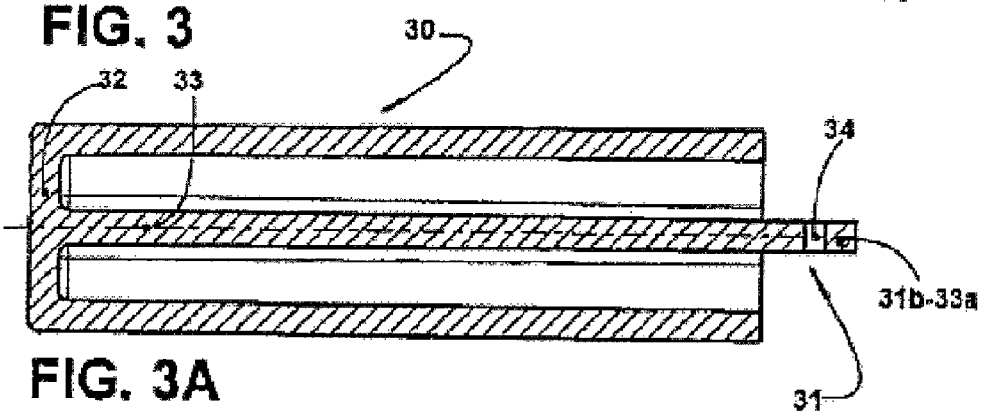
Figure 4:
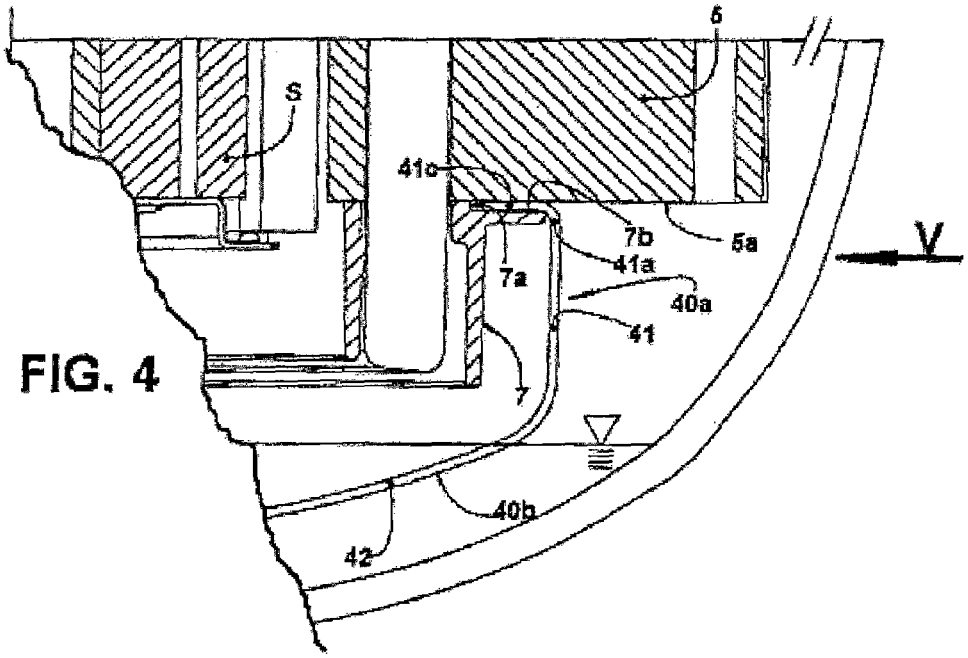
FIG. 4 represents, in a somewhat simplified form, an enlarged partial longitudinal sectional view of an articulation region of the fixation rod in the stator pack of the compressor.
Figure 7:
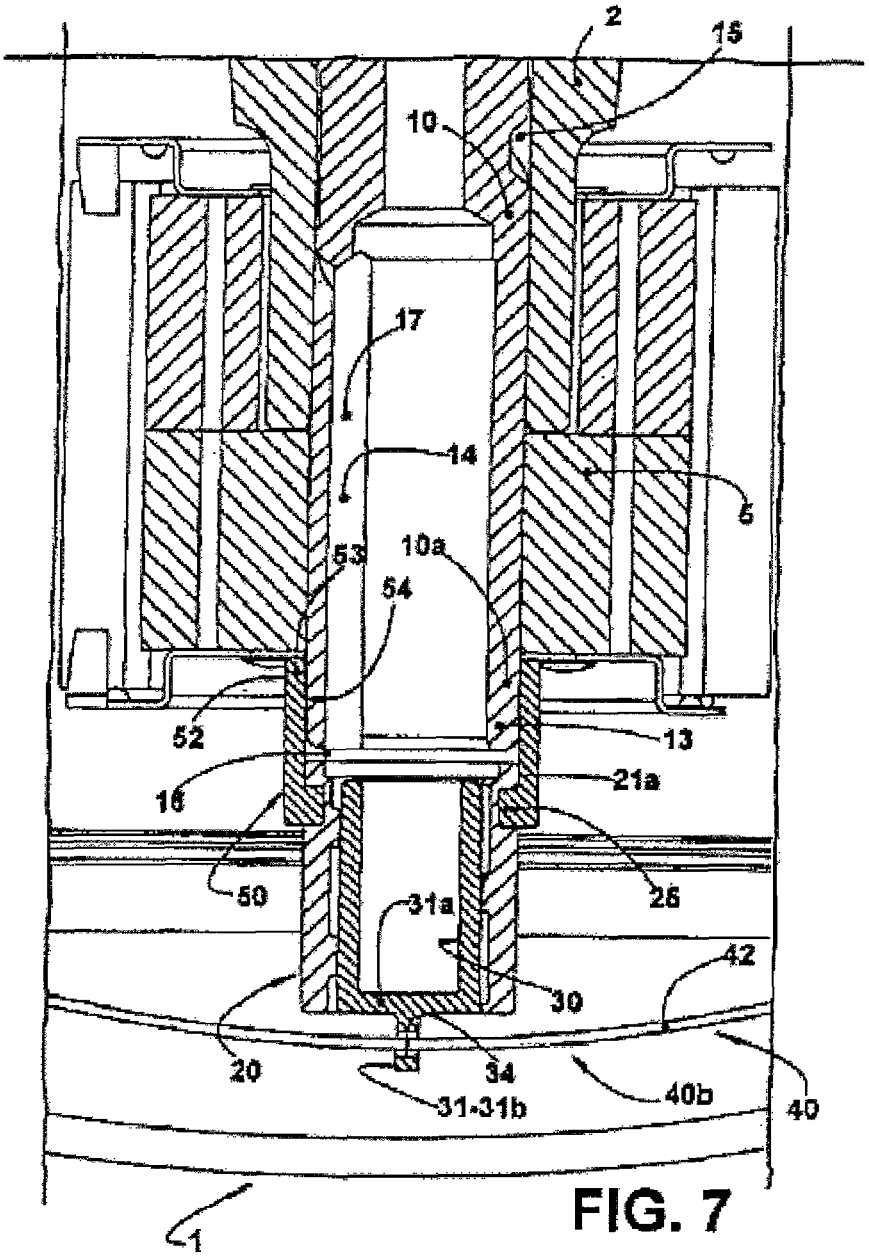
Figure 8:
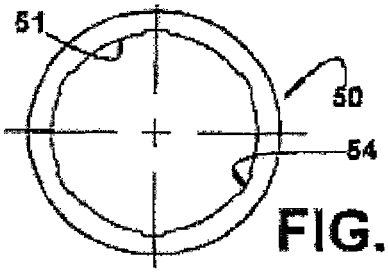
* and FIGS. 8 and 8*a* represent a plan view and a diametrical sectional view, respectively, of a metallic connector configured to provide the attachment of the non-metallic tubular sleeve of the oil pump to the central axial hole of the rotor illustrated in FIG. 6.
Figure 8A:
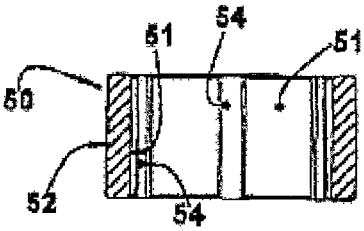

In the constructions illustrated in FIGS. 1*a* and 7, a lower extension of the crankshaft 10 projects downwardly from a rotor 6 of low height, to allow fitting and affixing the metallic tubular sleeve 20 thereon, by mechanical interference.

The mounting arrangement of the pump body 30 which constitutes a first aspect of the present invention does not depend on the constructive form of the rotor 6, on the material of the tubular sleeve 20 or on its fixation to the rotor or to the crankshaft 10.

The mounting of the pump body 30 in the interior of the tubular sleeve 20 is carried out so that an upper end portion 30*a* of said pump body 30 is maintained with a certain axial spacing in relation to the lower end 13 of the tubular end portion 12 of the crankshaft 10, said axial spacing being particularly defined in relation to an adjacent inner wall portion of the crankshaft 10. This axial spacing defines a first passage chamber 16 in the interior of the rotor 6 and to which is opened an upper end 24*a* of each helical groove 24 of each lubricant oil ascending channel C, allowing the fluid communication between the lubricant oil of the oil reservoir 4 and said first passage chamber 16. In some constructions, the first passage chamber 16 is also defined in the interior of the tubular sleeve 20, adjacent to the upper tubular portion 21 of the latter. In the illustrated constructions, the first passage chamber 16 maintains fluid communication with the vertical inner channel 14 of the crankshaft 10, conducting the lubricant oil to a second passage chamber 17 defined in the interior of the vertical inner channel 14, said second passage chamber 17 maintaining fluid communication with the external oil channel 15 of the crankshaft 10, conducting lubricant oil to the parts of the compressor to be lubricated.

In the oil pump constructions in which the tubular sleeve 20 is fixed in relation to the rotor, at least the tubular sleeve 20, which maintains permanent contact with one of the parts of crankshaft 10 (FIG. 1*a*) and rotor 6 (FIG. 1), is generally provided in a metallic material, such as the one that forms the part to which said tubular sleeve 20 is affixed. In these cases, in which all the involved parts are metallic, the mounting of the tubular sleeve 20 to the crankshaft 10 or to the rotor 6 occurs, for example, by mechanical interference, gluing, etc.

However, it is also possible for the tubular sleeve 20 (and, for example, also the pump body 30) to be provided in a non-metallic material, such as plastic. The construction of the parts of the tubular sleeve 20 and/or of pump body 30 in plastic material facilitates the manufacture of these components. Moreover, the manufacture in plastic material also minimizes the transfer of heat from both the rotor 6 and crankshaft 10 to the oil being pumped, due to the low thermal conductivity of said material.

However, the fixation of the tubular sleeve 20, in plastic material, to any of the parts of crankshaft 10 or to the rotor 6 presents the drawbacks already cited. In another aspect of the present invention regarding the mounting of the tubular sleeve 20 constructed in a non-metallic material to the rotor 6 or crankshaft 10, the tubular sleeve 20 has its upper tubular portion 21 externally provided with a circumferential groove 25, inside which is fitted and rotatively and axially retained a tubular metallic connector 50, to be telescopically mounted and retained in one of the parts of rotor 6 and crankshaft 10. This other constructive aspect of the present invention is illustrated in the constructions of FIGS. 5 and 7.

The tubular metallic connector 50 is mounted and retained to the respective part of crankshaft 10 and rotor 6 by any appropriate means, such as by mechanical interference, gluing, etc.

The fitting of at least part of the tubular metallic connector 50 to the circumferential groove 25 guarantees the axial locking of said tubular metallic connector 50 to the tubular sleeve 20. The rotational locking between said parts can be achieved by any adequate means, such as by interference, gluing, etc.

According to a way of carrying out the present invention, the tubular metallic connector 50 incorporates retaining elements, such as inner radial projections 51 (or also key slots), provided so as to be embedded in the plastic material of the tubular sleeve 20, in order to provide the rotational locking between said parts.

The fitting and retention of the tubular metallic connector 50 to the circumferential groove 25 of the tubular sleeve 20 may occur by elastic deformation of at least one of the parts of tubular metallic connector 50 and tubular sleeve 20. In a way of carrying out such fitting, the tubular sleeve 20 in plastic material is molded so as to surround at least part of the tubular metallic connector 50, which thus remains securely attached to the upper portion of said tubular sleeve 20. In this construction, the tubular metallic connector 50 presents an annular cross-section without interruption. In another constructive possibility (not illustrated), the tubular metallic connector 50 presents body portions fixable to each other and to be affixed around the tubular sleeve 20 of the oil pump, in the region of the circumferential groove 25, in order to facilitate mounting said tubular metallic connector 50 to the tubular sleeve 20. In an embodiment of this construction, the tubular metallic connector 50 is split and elastically deformed so as to be fitted around the tubular sleeve 20 in the region of the circumferential groove 25 thereof. The tubular metallic connector 50, after fitted in said circumferential groove 25, is closed to present a continuous side surface.

In the illustrated construction in FIG. 6, the tubular metallic connector 50 is completely fitted in the circumferential groove 25 and disposed inferiorly to the upper tubular portion 21 of the tubular sleeve 20. This construction is applied when the tubular sleeve 20 is mounted to the rotor 6, fitted in the central axial hole 6*a* of the latter. In this construction in which the central axial hole 6*a* of the rotor 6 has a lower extension not occupied by the crankshaft 10, the tubular metallic connector 50 presents an outer circumferential face 52 radially projecting beyond the contour of the tubular sleeve 20 and telescopically fitted and retained in the interior of the lower extension of the central axial hole 6*a* of the rotor 6.

In the illustrated construction in FIG. 7, in which the crankshaft 10 presents a lower end portion 10*a* axially projecting downwardly and outwardly from the rotor 6, which in this construction presents a small axial extension, the tubular metallic connector 50 incorporates a tubular axial extension 53, projecting beyond the upper portion 21 of the tubular sleeve 20 and having an inner circumferential face 54 telescopically fitted and retained around the lower end portion 10*a* of the crankshaft 10.

For any of the constructive forms presented above, the tubular sleeve 20 and the pump body 30 can present a constant circular cross-section along the respective longitudinal extension (FIGS. 1 and 2), or the parts of tubular sleeve 20 and pump body 30 can present a circular cross-section, but with a conical profile in their confronting surfaces (FIGS. 5 to 7). In this last construction, the wall thickness of said tubular sleeve 20 ranges from a reduced thickness, adjacent to its lower end 22*a*, in which the inner diameter of said tubular sleeve 20 is the largest of this construction, to a greater wall thickness in the region of an upper end 21*a* of the upper tubular portion 21 of the tubular sleeve 20, in which the inner diameter of said tubular sleeve 20 is the smallest of this construction. The variations of wall thickness and inner diameter of the tubular sleeve 20 are calculated so that they do not affect the pumping efficiency of the present oil pump. The construction with a constant circular cross-section has the advantage of providing a better performance for the oil pumping, although presenting more difficulty in obtaining the components when they are made in plastic material. The construction in a conical profile has the advantage of making easier to produce the component parts of the present oil pump when they are made in plastic material.

In a complementary form, a pump body 30 of conical construction presents a conical profile having a larger diameter adjacent to its lower end portion 31 and a smaller diameter adjacent to an upper end portion 30*a* of the pump body 30, opposite to said lower end portion 31, the diameter variation of said pump body 30 being gradual and continuous, as it occurs with the variation of the inner diameter of the tubular sleeve 20. It should be noted that the present solution further allows a stepped variation in at least one of the parts of inner diameter of the tubular sleeve 20 and outer diameter of the pump body 30, without impairing the pumping efficiency of the present pump.

While the concept presented herein has been described mainly considering the oil pump construction as illustrated, it should be understood that this particular construction does not restrict the applicability or scope of the present invention. The intention is to protect the principle and not the specific application or constructive form.

It should be understood that for any of the possible options for constructing and mounting the tubular sleeve 20 to the rotor and/or to the crankshaft 10, as well as for the construction of the tubular metallic connector 50, the oil pump of the present invention presents its pump body affixed to one of the parts of cylinder block 2 and stator 3 by means of a fixation rod 40, as cited above and which, for example, presents the construction described and illustrated herein, which should not be considered as limitative of the concept disclosed herein.

The invention claimed is:

1. A refrigeration compressor which comprises a shell containing lubricant oil and carrying a cylinder block journalling a crankshaft;

an electric motor having a stator affixed to the cylinder block and a rotor mounted around the crankshaft;

an oil pump coupled to the crankshaft and having:

a tubular sleeve having an upper tubular portion affixed to one of the parts of the crankshaft and the rotor; and a pump body disposed in the interior of the tubular sleeve and having a lower end portion carried by an assembly defined by the cylinder block and stator, so as to be freely displaced in the interior of the tubular sleeve in radial directions orthogonal to the rotation axis of the rotor and rotatively locked in relation to the rotor, and a tubular connector mounting and retaining the tubular sleeve by one of the parts of the rotor and the crankshaft, where the upper tubular portion of the tubular sleeve is provided with a circumferential groove inside which the tubular connector is fitted and rotatively and axially retained, and in which the rotor is provided with a central axial hole having a lower extension not occupied by the crankshaft, characterized in that the tubular connector is a metallic connector which presents an outer circumferential face radially projecting beyond the contour of the tubular sleeve and which is fitted and retained in the interior of the lower extension of the central axial hole of the rotor.

2. The refrigeration compressor, as set forth in claim 1, characterized in that the tubular metallic connector is mounted and retained, by interference, to the respective part of the crankshaft and the rotor.

3. The refrigeration compressor, as set forth in claim 1, characterized in that the tubular sleeve is a plastic material and the tubular metallic connector presents an uninterrupted annular cross-section.

4. The refrigeration compressor, as set forth in claim 3, characterized in that the tubular metallic connector incorporates inner radial projections embedded in the plastic material of the tubular sleeve, in order to provide the rotational locking between said parts.

5. A refrigeration compressor which comprises a shell containing lubricant oil and carrying a cylinder block journalling a crankshaft;

an electric motor having a stator affixed to the cylinder block and a rotor mounted around the crankshaft;

an oil pump coupled to the crankshaft and having:

a tubular sleeve having an upper tubular portion affixed to one of the parts of crankshaft and rotor;

a pump body disposed in the interior of the tubular sleeve and having a lower end portion carried by the assembly defined by the cylinder block and stator, so as to be freely displaced in the interior of the tubular sleeve in radial directions orthogonal to the rotation axis of the rotor and rotatively locked in relation to the rotor; and a tubular connector mounting and retaining the tubular sleeve in one of the parts of rotor and crankshaft, where the upper tubular portion of the tubular sleeve is provided with a circumferential groove inside which the tubular connector is fitted and rotatively and axially retained, and in which the crankshaft presents a lower end portion axially projecting downwardly and outwardly from the rotor, and the tubular connector incorporating a tubular axial extension projecting beyond the upper tubular portion of the tubular sleeve, characterized in that the tubular connector is a metallic connector and its tubular axial extension has an inner circumferential face fitted and retained around the lower end portion of the crankshaft.

6. The refrigeration compressor, as set forth in claim 5, characterized in that the tubular metallic connector is mounted and retained, by interference, to the respective part of the crankshaft and the rotor.

7. The refrigeration compressor, as set forth in claim 5, characterized in that the tubular sleeve is a plastic material and the tubular metallic connector presents an uninterrupted annular cross-section.

8. The refrigeration compressor, as set forth in claim 7, characterized in that the tubular metallic connector incorporates inner radial projections embedded in the plastic material of the tubular sleeve, in order to provide the rotational locking between said parts.

* * * * *